United States Patent [19]

Tønnessen

[11] 4,336,764

[45] Jun. 29, 1982

[54] MODIFICATION OF THE TOWER CONSTRUCTION IN A SPHERICAL TANK

[75] Inventor: Arne Tønnessen, Moss, Norway

[73] Assignee: Moss Rosenberg Verft A/S, Moss, Norway

[21] Appl. No.: 15,944

[22] Filed: Feb. 28, 1979

Related U.S. Application Data

[63] Continuation of Ser. No. 844,901, Oct. 25, 1977, abandoned.

[30] Foreign Application Priority Data

Oct. 26, 1976 [NO] Norway ..... 763650

[51] Int. Cl.[3] ..... B63B 25/08

[52] U.S. Cl. ..... 114/74 A; 220/1 B

[58] Field of Search ..... 405/53–58; 220/1 B, 18, 71; 62/55; 52/80; 114/73, 74 R, 74 A

[56] References Cited

U.S. PATENT DOCUMENTS

| | | | |
|---|---|---|---|
| 2,333,792 | 11/1943 | Jackson | 220/1 B X |
| 2,380,089 | 7/1945 | Ulm | 220/18 X |
| 2,531,742 | 11/1950 | Pomykala | 220/1 B X |
| 3,368,708 | 2/1968 | Pflederer | 220/71 X |
| 3,677,021 | 7/1972 | Bognaes et al. | 114/74 A X |

*Primary Examiner*—Dennis L. Taylor

*Attorney, Agent, or Firm*—Harold L. Stults; Pasquale A. Razzano

[57] ABSTRACT

In a spherical tank having a central vertical tower, the tower is rigidly connected to the tank shell at both ends, preferably by welding. The top of the spherical tank may be flattened in the area around the tower.

3 Claims, 4 Drawing Figures

MODIFICATION OF THE TOWER CONSTRUCTION IN A SPHERICAL TANK

Figure 1:
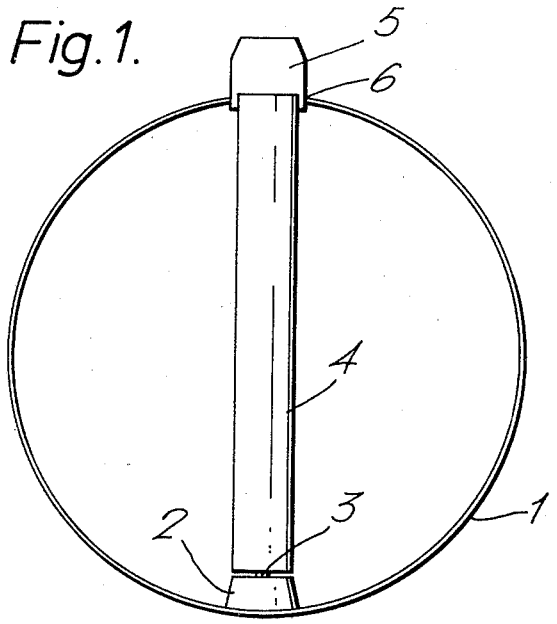

This is a continuation of application Ser. No. 844,901, filed Oct. 25, 1977.

The invention relates to a modification of the tower construction in a spherical tank containing a central vertical tower, see U.S. Pat. No. 3,680,323.

The invention has been developed in particular for application on spherical tanks supported by vertical skirts on ships, the tanks being used for transporting LNG and LPG. Tank systems of this type are known as Moss-Rosenberg spherical tank systems. In every tank, there is a tower or central column which contains the necessary conduits and associated equipment. The tower rests on a foundation or foot and is mounted on a central bearing which can transfer vertical and horizontal forces, but not moments. At its upper end, the tower can move freely in the vertical direction. Horizontal forces are taken up by guides on the tower and in the so-called "dome-neck". The guides also prevent the tower from rotating. Operating experience on board ship has shown that the guides at the upper end of the tower are subject to wear, but increasing the clearance at the upper end would result in wear on the lower bearing. It has proved difficult in practice to arrive at a satisfactory structural solution for the guides.

The object of the invention is to avoid sliding surfaces and wear problems and to obtain a simpler, and thus less expensive construction, especially for the foot of the tower. Another goal is to reduce the loading on the tank shell in the tower foot region and to avoid vibrations of the dome, i.e., the construction on top of the spherical tank, directly above the tower.

This is achieved by a departure from the principles on which the construction has been based heretofore, in that the spherical tank and tower are made such that the tower is rigidly connected to the tank shell at both ends. Preferably, the tower is welded to the tank shell.

With a tower that is rigidly connected to the tank shell at both ends, the maximum loading on the tank shell will be reduced under all operating conditions. One will of course get loading on the tank shell and tower during the cooling period, because contraction of the tower will be restricted. These loads, however, will be significantly lower than the maximum allowable loading.

In addition, tanks having a fixed tower will be able to withstand a significantly higher interior overpressure when the ship is in port. This makes it possible to carry out an efficient emergency discharge of cargo by means of pressure (which might be required if the pumps are inoperative).

A simpler and less expensive construction is obtained with the new design, especially at the foot of the tower, and loads on the tank shell at the foot of the tower are reduced. Vibration of the dome is also prevented, as the dome is more rigidly mounted.

Forces owing to relative displacements between the tower and tank, e.g., when the tank is being cooled down, can be reduced if desired by flattening the top of the tank somewhat relative to a strictly spherical shape. The tank will thus be rendered more flexible.

The invention enables one to avoid the disadvantages of the previously known structures. The loads on the tower and bearing with the known constructions comprise (a) the specific gravity plus an additional dynamic load (vertical), (b) horizontal mass forces, and (c) horizontal forces owing to the movement of liquid relative to the tower. One must also contend with relative displacements between the tower and tank shell in the vertical direction, because when the tanks are being cooled down, the tower is cooled down more rapidly than the tank shell. In addition, the tank shell can be deformed owing to compressive loads. With the new construction, however, one avoids the previous problems and obtains the advantages mentioned above. The invention therefore represents a novel solution which unexpectedly provides technical advantages over the previous constructions.

Figure 2:
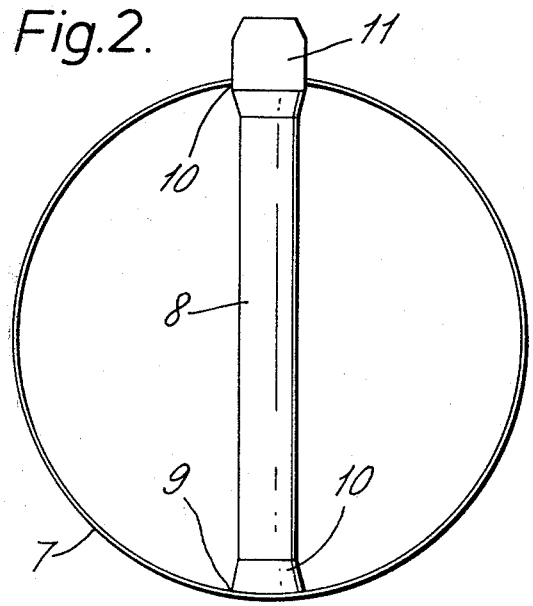
Figure 3:
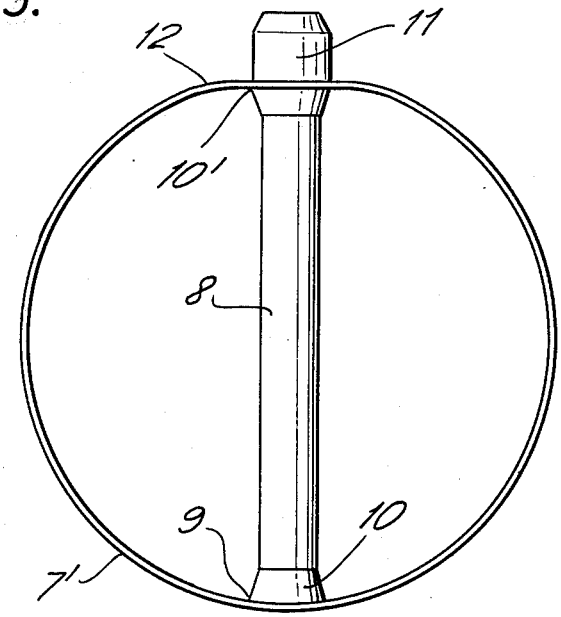
Figure 4:
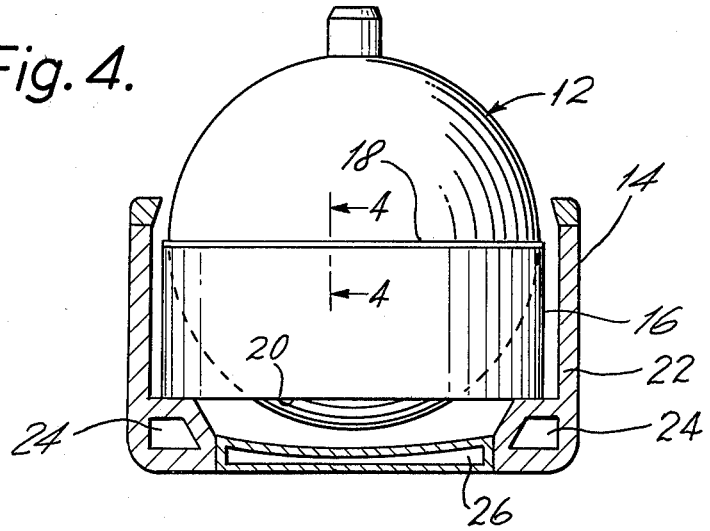

The invention will be explained in more detail with reference to the accompanying drawings, where:

FIG. 1 is a schematic cross section through a known embodiment of a spherical tank and tower, FIG. 2 is a cross section through an embodiment of the spherical tank having the new tower mounting, FIG. 3 shows a modified embodiment of the new construction, and FIG. 4 is a schematic vertical sectional view of the ship in which the tank of FIG. 2 is positioned.

On FIG. 1, the spherical tank is designated by 1. At the bottom of the tank is a tower foot 2 which supports by means of a bearing 3 a tower 4 which extends up centrally through the spherical tank 1 and into a dome 5 positioned on top of the spherical tank. The tower can move freely in the vertical direction in guides located in the so-called dome neck 6. The bearing 3 can transfer vertical and horizontal forces, but not moments. As mentioned previously, the upper end of the tower is free to move in the vertical direction, while horizontal forces are taken up by guides on the tower and dome neck. These guides also prevent the tower from rotating. The guides are not shown, as their construction is known per se. Experience has shown that the guides at the upper end of the tower are subject to wear. Increasing the clearances in this region would result in wear on the bearing 3. It has been difficult to find a satisfactory constructional solution to this problem with the guides.

The new embodiment is shown on FIG. 2, where the spherical tank is designated 7. A tower 8 is positioned centrally in the spherical tank and is welded inside the tank at 9 and 10. At the bottom, the tower is often given a conical shape at 10, and is also widened conically at the top and is extended by a dome 11 which in reality forms a part of the tower.

With this type of construction, sliding surfaces (wear surfaces) are avoided entirely. Calculations have shown that a welded tower of this type results in a reduction of the maximum loading on the tank shell under all operating conditions. The loads on the tank shell and tower at all times will be significantly lower than the maximum allowable loads and thus represent no problem.

Referring to FIG. 4, a marine vessel has a hull 14 within which tank 7 is positioned. The tank is supported by a skirt 16 which rests at its bottom edge 24 upon the hull and which is positioned at its upper edge 18 around the horizontal equator of the tank. The skirt is rigidly attached to the tank and to the hull whereby the tank is supported by the hull through the skirt with the respective upper and lower hemispheres of the tank being rigidly connected at their peripheries to the skirt.

FIG. 3 shows a modification of the embodiment of FIG. 2, whose purpose is to reduce the forces which result from relative displacements between the tower and tank, during cooling, for example. In this design, the spherical tank 7′ is flattened somewhat at the top, i.e., in the region of the upper connection 10′ of the tower to the tank shell. The flattened portion is designated by 12. The construction otherwise is the same as that of FIG. 2. The flattened portion makes the tank more flexible, thereby reducing the forces on the tank shell.

The commonly-used vertical skirt support is not shown on the drawings, as the invention can also be applied to spherical tanks supported in some other fashion, and is not restricted solely to spherical tanks on ships.

Having described my invention, I claim:

1. In a marine vessel having a hull structure, a spherical tank adapted to contain liquefied gas and supported by an annular skirt having a vertical axis and positioned around the horizontal equator of said tank with said skirt being rigidly attached to said tank and to said hull whereby said tank is supported by said hull through said skirt with the respective upper and lower hemispheres of the tank being rigidly connected at their peripheries to said skirt, and a vertical tower which is rigid and is positioned within said tank with its axis substantially concentric with said axis of said skirt, said tower extending vertically between the top and bottom extremities of said tank with the ends thereof being rigidly connected to the respective of said extremities of said tank to thereby form an integral structure comprising said tower and said hemispheres.

2. The construction as described in claim 1 wherein the top portion of said tank is substantially flat throughout the area surrounding the top end of said tower.

3. The construction as described in claim 2 which includes a dome at the top of said tower and rigidly attached thereto.

* * * * *